US009284708B2

(12) United States Patent
Neville

(10) Patent No.: US 9,284,708 B2
(45) **Date of Patent: *Mar. 15, 2016**

(54) SCREW PILE SUBSTRUCTURE SUPPORT SYSTEM

(76) Inventor: Steve Neville, Simi Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/688,836

(22) Filed: Jan. 15, 2010

(65) Prior Publication Data

US 2010/0247247 A1 Sep. 30, 2010

Related U.S. Application Data

(63) Continuation of application No. 11/367,768, filed on Mar. 2, 2006, now Pat. No. 7,914,236.

(60) Provisional application No. 60/657,857, filed on Mar. 2, 2005.

(51) Int. Cl.
*E02D 5/56* (2006.01)
*E02D 7/22* (2006.01)

(52) U.S. Cl.
CPC ... *E02D 5/56* (2013.01); *E02D 7/22* (2013.01)

(58) Field of Classification Search
CPC ..... E02D 5/56
See application file for complete search history.

(56) References Cited

U.S. PATENT DOCUMENTS

| | | | | |
|---|---|---|---|---|
| 108,814 A | | 11/1870 | Moseley | |
| 204,246 A | * | 5/1878 | Pierce | 52/157 |
| 3,206,936 A | | 9/1965 | Moor | |
| 3,226,855 A | | 1/1966 | Smith | |
| 4,623,025 A | | 11/1986 | Verstraeten | |
| 4,708,530 A | * | 11/1987 | Faber | 405/252 |
| 4,813,816 A | | 3/1989 | Simanjuntak | |
| 4,832,552 A | | 5/1989 | Skelly | |
| 5,575,593 A | * | 11/1996 | Raaf | 405/237 |
| 6,082,472 A | | 7/2000 | Verstraeten | |
| 6,394,704 B1 | * | 5/2002 | Saeki et al. | 405/252.1 |
| 6,468,003 B2 | | 10/2002 | Merjan et al. | |
| 7,914,236 B2 | * | 3/2011 | Neville | 405/244 |

(Continued)

FOREIGN PATENT DOCUMENTS

| | | |
|---|---|---|
| DE | 4220976 C1 | 7/1993 |
| EP | 0157033 A1 | 10/1985 |
| EP | 0855489 B1 | 4/2003 |

(Continued)

OTHER PUBLICATIONS

Written Opinion of the International Searching Authority and International Search Report; dated May 22, 2008; 5 pages for PCT/US06/07949.

(Continued)

*Primary Examiner* — Sunil Singh
(74) *Attorney, Agent, or Firm* — Gabriel Fitch; Loza & Loza, LLP

(57) ABSTRACT

A screw pile substructure support system comprises a tubular pile with a fixed conical tip having a helical flight thereon which draws the pile into a soil bed when a torque is applied to the pile. The tip has a substantially conical shape, and the largest diameter of the tip is substantially the same as the diameter of the tubular pile to which it is attached. The helical flight is attached to the outside surface of the tip. The tip may also be provided a point tip and one or more cutting teeth attached its surface.

39 Claims, 11 Drawing Sheets

(56) References Cited

U.S. PATENT DOCUMENTS

| | | | |
|---|---|---|---|
| 2004/0076479 | A1 | 4/2004 | Camilleri |
| 2004/0251050 | A1 | 12/2004 | Shahin et al. |

FOREIGN PATENT DOCUMENTS

| | | | | |
|---|---|---|---|---|
| GB | 2070668 | A | * | 9/1981 |
| GB | 2132667 | A | | 7/1984 |
| JP | 56-12431 | | | 2/1981 |
| JP | 56012431 | A | * | 2/1981 |
| JP | 62-194320 | | | 8/1987 |
| JP | 62194320 | A | * | 8/1987 |
| JP | 64-29520 | | | 1/1989 |
| JP | 05-106223 | | | 4/1993 |
| JP | 05086791 | A | * | 4/1993 |
| JP | 06280258 | | | 10/1994 |
| JP | 06280258 | A | * | 10/1994 |
| JP | 200261180 | a | * | 2/2002 |
| JP | 2003293361 | a | * | 10/2003 |
| WO | WO 0009833 | A1 | * | 2/2000 |

OTHER PUBLICATIONS

European Search Report for EP Application No. 06721155.7; dated Nov. 29, 2011; 3 pages.

Office action in related U.S. Appl. No. 13/458,890, filed Apr. 27, 2012, inventor Steve Neville, Office action mailed Mar. 27, 2014 (11 pgs.).

* cited by examiner

SCREW PILE SUBSTRUCTURE SUPPORT SYSTEM

CROSS-REFERENCE TO RELATED APPLICATION

This application is a continuation of U.S. patent application Ser. No. 11/367,768, filed Mar. 2, 2006 now U.S. Pat. No. 7,914,236, the entire content of which is incorporated herein by reference, which claims the benefit of U.S. Provisional Application No. 60/657,857, filed Mar. 2, 2005, the entire content of which is incorporated herein by reference.

FIELD OF THE INVENTION

The present invention relates to the installation of foundation piles in a soil bed, and particularly to a method and apparatus for the installation of a high capacity rotational substructure piling system.

BACKGROUND OF THE INVENTION

The installation of conventional foundation piles has previously been accomplished by driving a precast concrete pile or steel beam or vibrating an H pile into a soil bed. When driving a foundation pile, the soil surrounding the pile may be compacted in various ways as well as disrupted by the seismic shocks of the pile driver itself. When driving a pile into hard ground, earth displaced by the pile causes the ground surrounding the pile to heave. In contrast, when driving a pile into soft ground, settling of the surrounding soil may be caused. All of these conditions can cause problems for any standing structures in the area of the pile being driven.

The installation of conventional piles has also previously been accomplished by pre-drilling a hole in a soil bed using an auger and lowering a pre-molded pile into the hole. A hybrid system also exists between the driving and drilling methods whereby an open ended pile such as a pipe pile is driven into a soil bed, after which point the soil inside the pile is augered out and concrete is poured in the cavity formed therein. Cast and hole methods as well as casons may also be used, specifically where there are concerns for preserving nearby buildings against the problems discussed above. However, all these methods can prove either costly and/or slow to carry out in the field. Furthermore, where the ground in a job site is deemed to be contaminated, any soil removed from the ground, such as that produced by an auger, must be disposed of properly presenting an additional problem and associated cost.

A more complex system is known whereby a pile is attached to a drill head which is substantially larger than the diameter of the pile itself. The pile is turned together with the drill head by a drilling rig to create a passage in the soil bed through which the pile may pass. A conduit is provided through the center of the pile for water or grout to be pumped down and out the tip of the drill head to either float away debris or anchor the pile in its final resting place in the soil bed. Another system, known as an under-reamer system, features a double torque head which turns a drill in the center of a pipe, which pipe is itself turned in the opposite direction from the drill. Although they do have certain advantages over other known systems, both of these drilling systems are obviously substantially more complex, and therefore more costly than the first several prior art systems discussed.

Both driving and drilling systems used to place foundation piles rely in part on brute force to either force a pile into a soil bed, or to cut and remove material. What is needed is a more elegant approach to foundation pile placement providing such benefits as may include a faster pile placement speed, lower cost and greater ease of use) as well as higher load capacity piles.

SUMMARY OF THE INVENTION

Accordingly, in an exemplary embodiment, a screw pile substructure support system comprises a tubular pile having a centerline and a first diameter, a substantially conically shaped pile tip sharing a centerline with the tubular pile, the substantially conically shaped pile tip having a first end and a second end, the second end being connected to the tubular pile and having a second diameter and a helical flight attached to the outside surface of the substantially conically shaped pile tip, wherein the first diameter is substantially similar to the second diameter.

In a further embodiment, the screw pile substructure support system has a length, and the first diameter is substantially constant throughout the length. In yet another embodiment, the screw pile substructure support further comprises at least one cutter tooth attached to the outside surface of the substantially conically shaped pile tip and extending radially outwards from the centerline.

Figure 1:
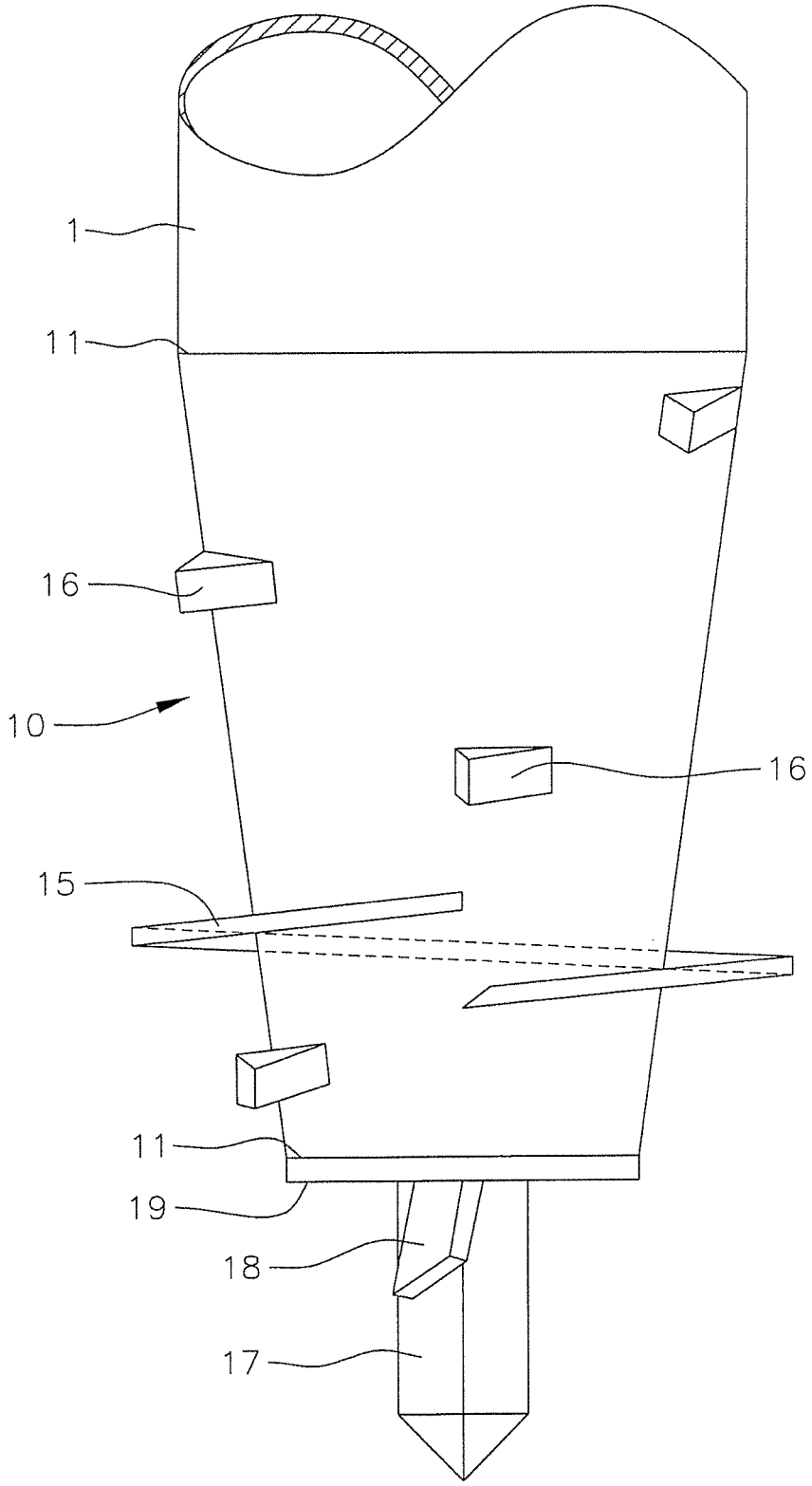
FIG. 1 shows a conical pile tip according to one embodiment of the present invention.

Before any embodiment of the invention is explained in detail, it is to be understood that the invention is not limited in its application to the details of construction and arrangements of components set forth in the following description, or illustrated in the drawings. The invention is capable of alternative embodiments and of being practiced or being carried out in various ways. Specifically, numerical dimensions where they appear on the following drawings represent those of exemplary embodiments only and may be modified by one skilled in the art as conditions warrant. Also, it is to be understood, that the terminology used herein is for the purpose of illustrative description and should not be regarded as limiting.

DETAILED DESCRIPTION OF THE INVENTION

A method and apparatus is provided for the installation of a foundation pile in a soil bed. In contrast to prior art drilled foundation pile systems which use a low torque and an efficient drill tip which must be retrieved from the drilling site after drilling is complete, in an exemplary embodiment of the present invention a pile is provided with a fixed tip having a helical flight thereon which draws the pile into a soil bed when a torque is applied to the pile. FIG. 1 shows a conical pile tip 10 connected to a pile 1 according to one embodiment of the present invention, wherein the pile tip 10 allows the pile 1 to be set into a soil bed by applying a torque to the distal end of the pile 1 (not shown) using a standard drilling rig. The rig may additionally apply a crowd pressure to the pile 1 along with the torque to further aid in placement of the pile 1 in the soil bed to provide substructure support system for a large scale construction project.

In one embodiment, the pile tip 10 is comprised of a substantially conically shaped body sharing a centerline with the pile 1 to which it is attached, as well as a helical flight 15 attached to the outside surface of the pile tip 10, and cutter teeth 16 extending out radially from the centerline of the pile tip 10. The helical flight 15 helps draw the pile tip 10 down into a soil bed during placement, and the cutter teeth 16 serve to break up the soil to allow the pile tip 10 to better penetrate into the bed. In an exemplary embodiment, the flight 15 is formed from a half-inch thick plate, has a pitch of three inches and is attached to the body of the pile tip 10 so that its lowest edge lies three inches above an end plate 19. The end plate 19 caps off the end of the conical body of the pile tip 10, closing it off from the soil in which it is to be placed. A point shaft 17 and cutter teeth 18 are provided extending out axially from the end plate 19 of the pile tip 10. The point shaft 17 helps keep the pile tip 10 centered during installation of the pile 1 in a soil bed and both the point shaft 17 and the cutter teeth 18, like the cutter teeth 16, serve to break up the soil to allow the pile tip 10 to better penetrate into the bed. In one embodiment, the pile tip 10 is provided with seven cutter teeth in total.

The pile tip 10 may be fabricated from individual pieces which are cut out and formed to specification before being welded together. The main body of the pile tip 10, as well as the flight 15 and the end plate 19 may all be cut from pieces of plate stock. The main conical body and the flight may be rolled, heated and otherwise formed into the required shape before being welded together along with the end plate 19 along the welds 11. In one embodiment, full penetration welds may be used for this purpose. The cutter teeth 16, point shaft 17 and cutter teeth 18 may also be fabricated from steel stock and welded onto the pile tip 10. In one embodiment, A35-grade standard milled steel may be used for these components. In a further embodiment, the pile 1 is 12.75" in diameter and has ⅜" walls, and the pile tip 10 may be attached to the pile 1 using the same type of weld 11 utilized in the fabrication of the pile tip 10 itself. As a cost saving measure, material for the pile 1 may be supplied by recycled gas piping. Those skilled in steel fabrication will understand that numerous alternatives are available for the fabrication of the pile tip 10 and the assembly of the pile tip 10 and the pile 1 without deviating from the principles of the invention described herein. For example, the pile tip 10 could be cast as a single unit rather than hand fabricated from separate pieces of steel stock.

Figure 2:
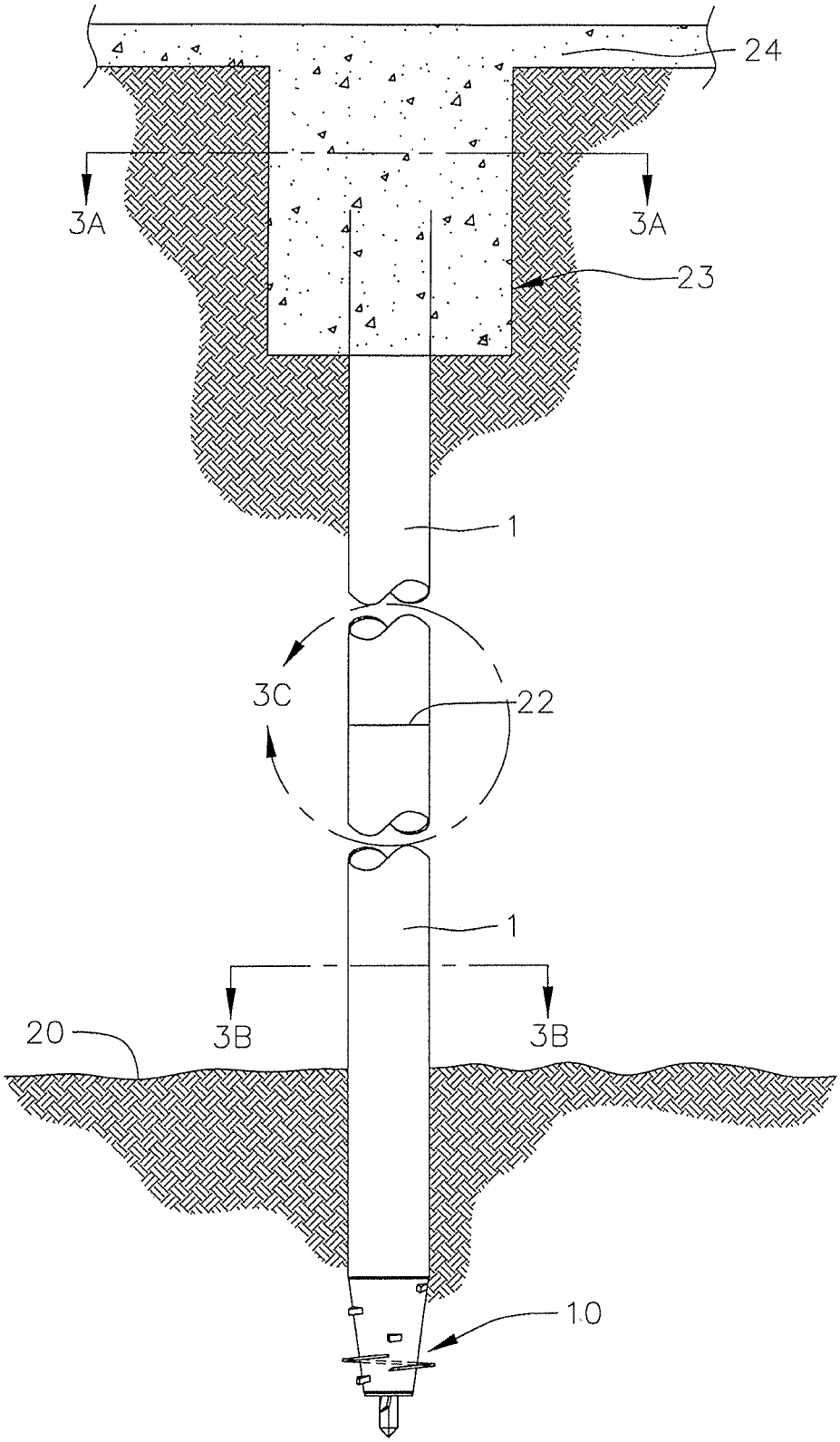
FIG. 2 shows a concrete-filled steel pipe pile according to a further embodiment of the present invention.

FIG. 2 shows an assembly comprising a complete pile 1 together with a pile tip 10 installed in a soil bed. As is known in the art, pile substructure systems are commonly used in soil beds comprising a fill layer and potentially a liquid layer, beneath which lies a solid layer 20 which may be a sand or granular layer. The solid layer 20 may lie as much if not more, than 40' or 50' below the surface of the soil. As such, the pile 1 must pass down through many feet of looser soil components before it is able to anchor several feet into the solid layer 20. To provide a pile 1 of sufficient length, several pieces of pipe may be joined together lengthwise as shown through the use of the pipe splices 22, which may be full penetration welds of the type shown in FIG. 1 by the welds 11. In one embodiment, the pile 1 may be a concrete—filled steel pipe pile. Various numbers of spliced members may be assembled into a complete pile 1 of various lengths depending on the depth of the solid layer 20 at the installation site of the pile. After installation of the pile 1, a pile cap 23 may be placed thereon to support a slab 24, which may be a poured concrete lab.

A standard drilling rig may be used to turn the assembly of the pile 1 and the pile tip 10 into the soil bed, and ultimately the solid layer 20. The specifics of the method of attachment of the pile 1 to the rig are shown in detail in later figures. In most if not all embodiments, there will be no need for pre-drilling the installation site for the pile 1, soil conditions permitting. Rather, the pile 1 with the attached pile tip 10 will be set up in a standard drilling rig and turned into the previously undisturbed soil bed, while simultaneously a downward crowd pressure is applied by the rig on the pile 1. As described in reference to FIG. 1, the inclusion of the helical flight 15 on the pile tip 10 helps draw the pile 1 down into the soil bed as it is turned by the drilling rig, and the cutter teeth 16 and 18 as well as the point shaft 17 help break up the soil to ease the passage of the pile tip 10 downward through the soil bed.

As is known in the art, tie downs to adjacent and previously installed piles or another suitable anchor may be used to prevent uplift of the drilling rig as the crowd pressure is applied. Again, depending on the requirements imposed on the job by existing soil conditions, varying levels of crowd pressure and torque may be required, including amounts up to 50 or 60 thousand pounds of crowd and 212 thousand foot pounds of torque, which levels are within the capacities of standard, commercially available drilling rigs.

The exemplary embodiment of a pile 1 equipped with a pile tip 10 described herein performs exceedingly well when being installed in soils with a high clay content, including those with hard clays. The screw pile or TORQUE DOWN pile, TORQUE DOWN is a trademark of Substructure Support Inc. of Oakland, Calif., may also be installed in sandy soils, though possibly with more difficulty, particularly with soils containing very fine or light sands. However, the embodiment of the present torque down pile system may still be installed with considerably less difficulty when compared to known methods of installing driven piles in such sandy soil conditions. Furthermore, the present screw pile system may be installed in conditions, such as in fine sandy soils such as those with blow counts above approximately 50 and up to between approximately 60 and 70, in which driven piles may be installed only with extreme difficulty if they may be installed at all.

As further described in reference to FIG. 1, the helical flight 15 may be provided as part of the pile tip 10 having a pitch of three inches. This pitch could be varied depending on expected soil conditions; for example it could be lessened slightly to 2¾" if slightly harder soils are expected. Given that lessening the pitch of the flight decreases the speed at which the pile tip 10 turns into the soil while allowing harder soil conditions to be penetrated, and increasing the pitch of the flight has the opposite effect in both cases, it is desirable to provide an embodiment of flight 15 having a pitch which minimizes the disturbance to the soil surrounding the pile 1 as the pile 1 is sunk into the soil bed. As discussed above, prior art methods of pile placement, whether through driving or drilling, significantly disturb the soil surrounding the pile 1. However, the present screw pile may be placed close to pre-existing structures without the concern that heaving, settling or seismic disturbance will damage the structure. Furthermore, in contrast to prior art systems, with the embodiment of the present invention described herein while a volume of soil equal to the volume of the pile and tip is displaced as the pile is sunk, the remainder of the soil remains either compacted or undisturbed. The compacted nature of the soil provides excellent stability when a pile 1 and pile tip 10 assembly are installed in a soil bed as shown in FIG. 2.

The improved stability provides much better support for the pile itself, leading to increased load tolerances for piles installed in this manner, and the ability to use smaller diameter piles to support a load requirement. As is known in the art, installed piles may be tested with a jack tester to verify their integrity. TORQUE DOWN piles 12.75" in diameter and having ⅜" thick walls as well as poured concrete interiors placed in representative soil conditions have been tested in this manner and found to be capable of supporting approximately one million pounds; far more than is possible with a driven or drilled pile of a similar diameter. Accordingly, the load which these TORQUE DOWN piles is capable of supporting exceeds the mandated structural tolerances of the pile itself.

In addition to supporting increased loads over prior art piles, the screw pile according to the embodiment of the present invention described herein can be installed much faster than prior art piles. While speed is as always dependent on the soil conditions it is known in the art that with conventional driven piles, the best that can be expected in favorable soil conditions is to drive approximately two piles between forty and sixty foot in length each per hour. In contrast, between approximately three and four of the present screw piles of the same length can be turned into a similar soil bed in the same amount of time. As such, a job with a defined number of piles can be finished more quickly with the same size crew as compared to prior art pile systems. This provides a cost savings to the foundation contractor, which savings will of course be multiplied as the size of a job increases.

Figure 3A:
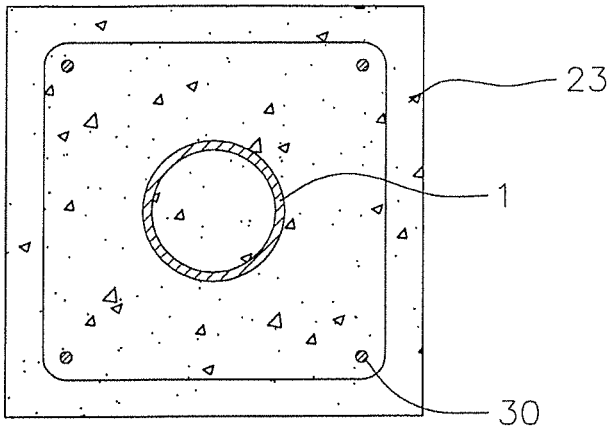
FIGS. 3A, 3B and 3C show specific detailed views taken along the lines 3A, 3B, and 3C shown in FIG. 2.
Figure 3B:
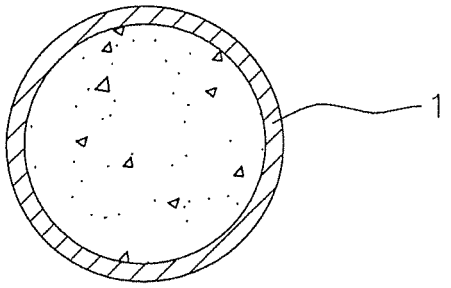
Figure 3C:
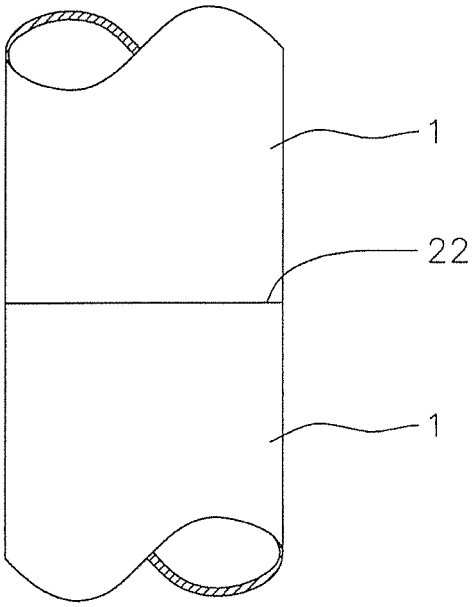

FIGS. 3A, 3B and 3C show specific detailed views taken along the lines 3A, 3B, and 3C shown FIG. 2. In FIG. 3A, a pile cap 23 is shown attached to the top of a pile 1 in a manner known in the art. Reinforcing steel 30 may also be provided. FIG. 3B shows a cross-section of a concrete filled pile 1 having the dimensions specified. FIG. 3C shows a individual sections of material joined by pipe splices 22 to form a unitary pile 1 of an appropriate length for a specific job.

Figure 4:
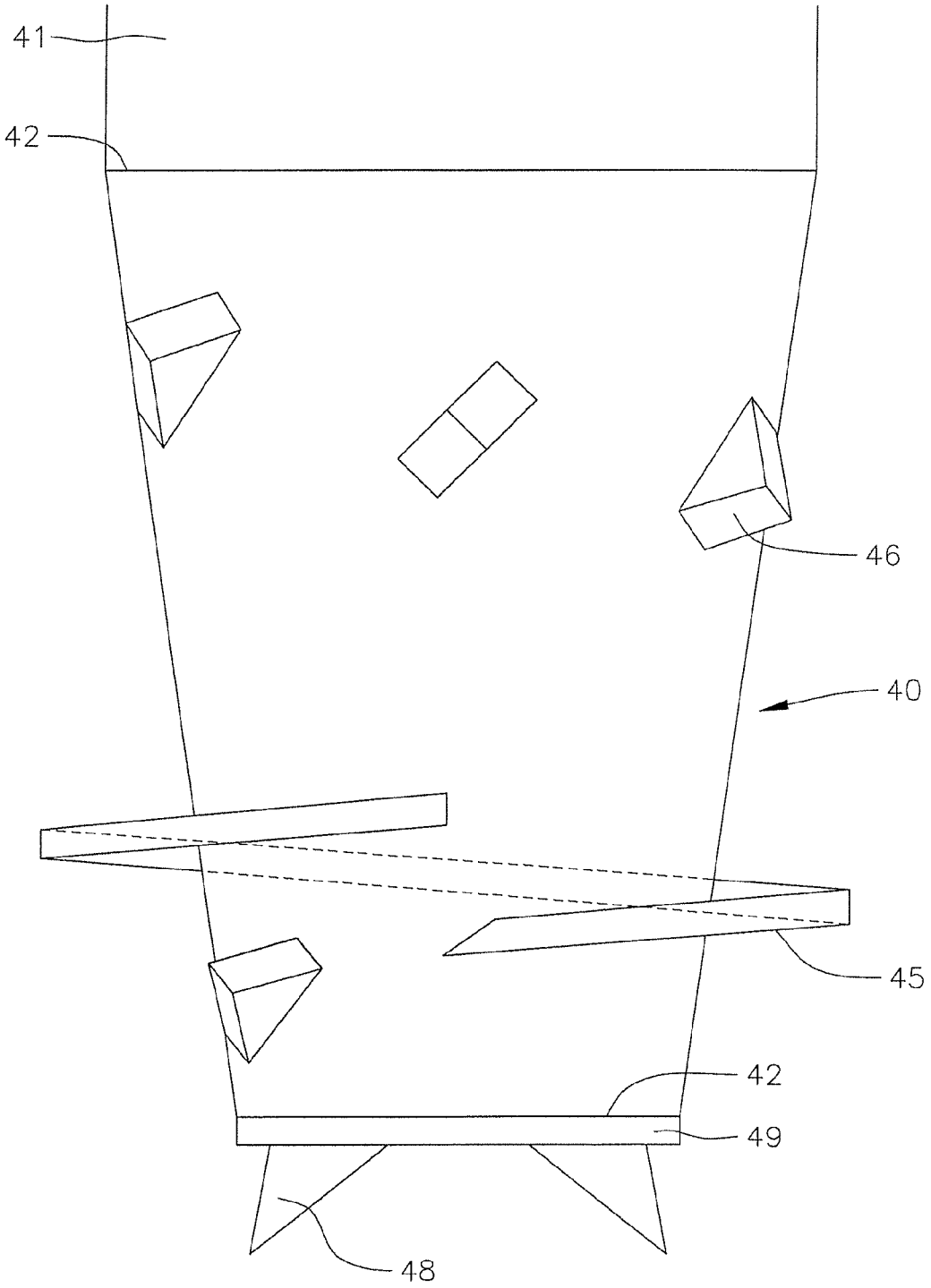
FIG. 4 shows another embodiment of a conical pile tip.
Figure 5:
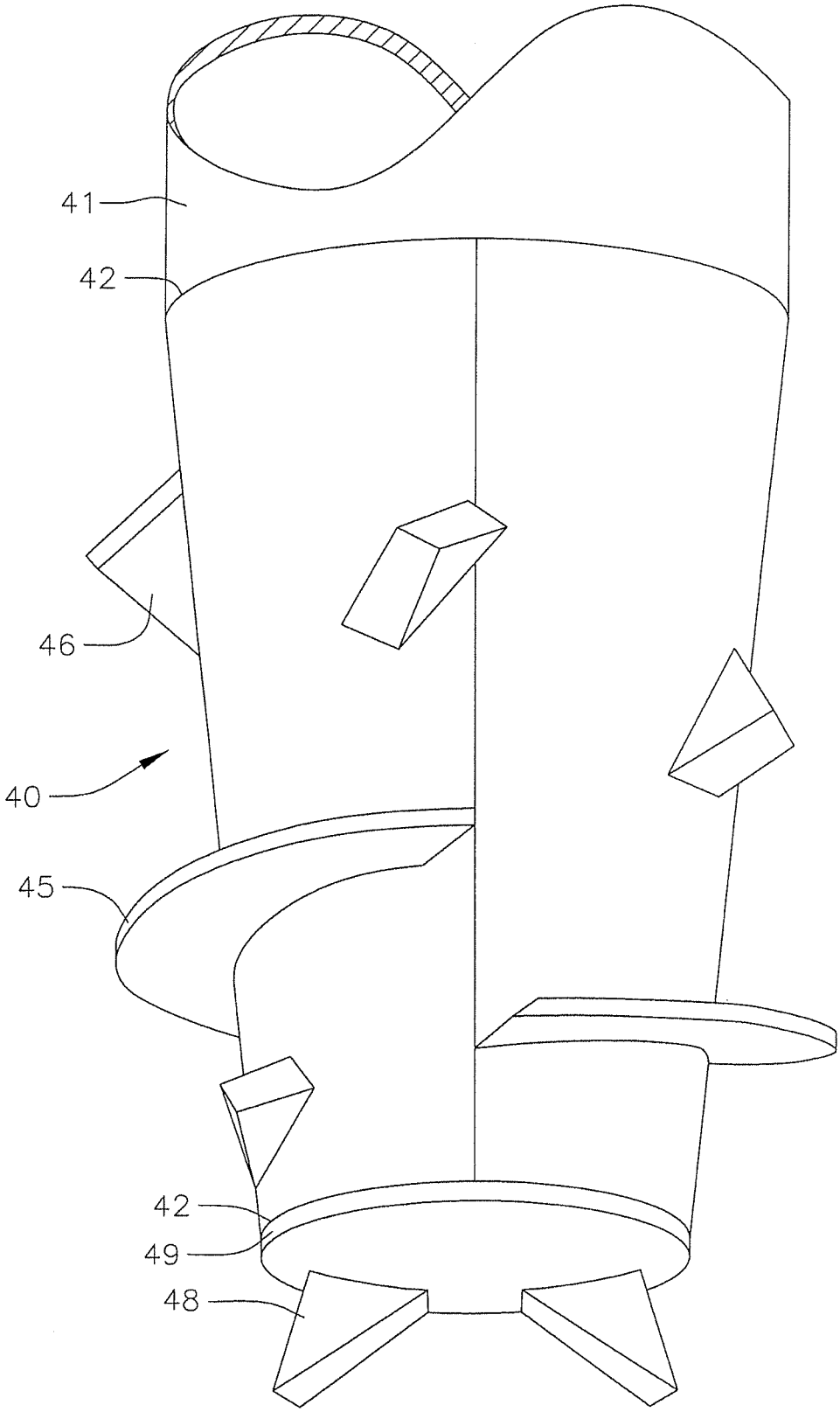
FIG. 5 shows yet another embodiment of a conical pile tip.

FIGS. 4 and 5 show alternative embodiments of a conical pile tip 40 comprised of a substantially conically shaped body sharing a centerline with the pile 41 to which it is attached, as well as a helical flight 45 attached to the outside surface of the pile tip 40, and cutter teeth 46 extending out radially from the centerline of the pile tip 40. In the embodiment shown, the cutter teeth 46 are provided disposed in a spiral pattern on the outside surface of the pile tip 40 and spaced vertically apart from one another in one inch intervals. An end plate 49 is provided as a bottom surface to the conical body of the pile tip 40. Triangular cutter teeth 48 are provided extending out axially from the end plate 49 of the pile tip 40, which pile tip 40 is not provided with a point shaft in the embodiment shown in contrast with the pile tip 10 of FIG. 1.

Figure 4A:
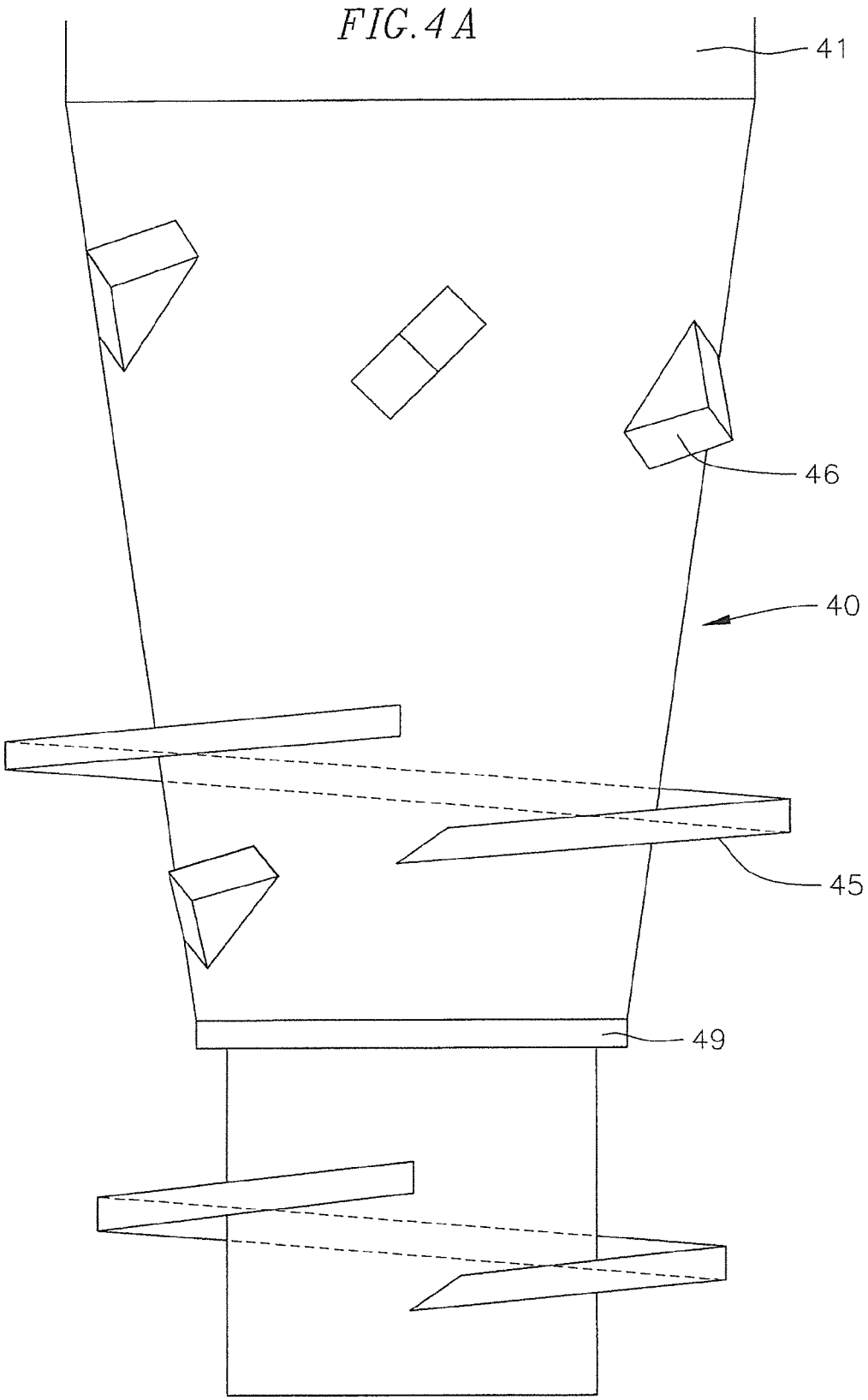
FIG. 4A shows still another embodiment of a conical pile tip.

In an alternative embodiment, a bifurcated point shaft may be provided as a component of the pile tip 40 having two prongs, and in a further alternative embodiment these prongs may be twisted in a helix to better serve to break up soil to allow the pile tip 40 to more easily be turned into a soil bed. In another embodiment, the pile tip 40 may be provided with hardened or carbide tipped cutter teeth 46 or 48 to better stand up to harder soil conditions; the edge of the flight 45 may also be hard surfaced for the same reason. In yet another alternative embodiment, additional flights 45 could be added on the outside surface of the pile tip 40. In yet another alternative embodiment, the pile tip 40 may be provided with an extended shaft thinner in diameter than the end plate 49 and extending out axially from the end plate 49 in place of a point shaft. This extended shaft may include its own helical flight or flights separate from the flight 45 provided on the outside surface of the pile tip 40. FIG. 4A illustrates the extended shaft with its own helical flight.

Figure 6:
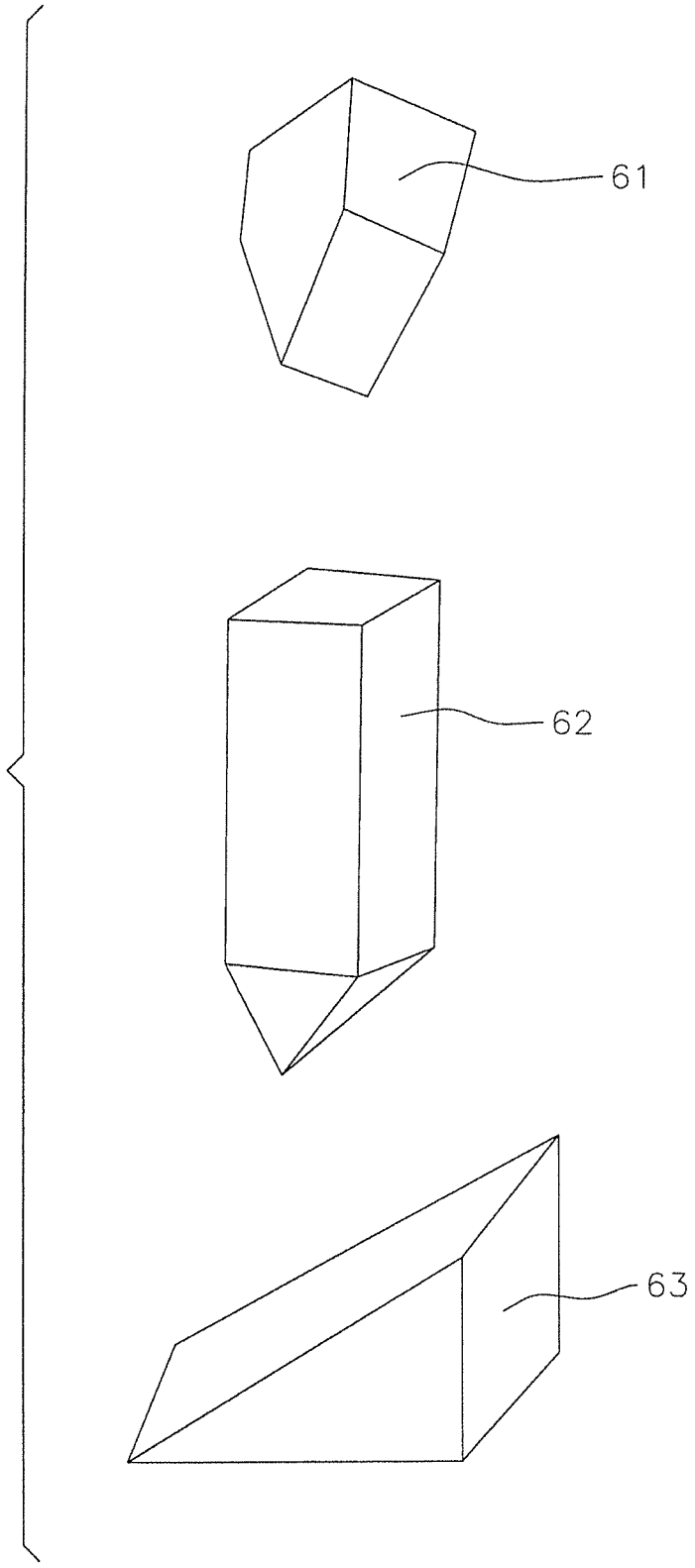
FIG. 6 show various embodiments of cutter teeth for use with a conical pile tip.

FIG. 6 show various embodiments of cutter teeth for use with a conical pile tip. Namely, a point shaft 62 and cutter tooth 63 are shown which may be provided extending out axially from the end plate of a pile tip 40. A cutter tooth 63 is also shown which may be provided extending out radially from the centerline of a pile tip.

Figure 7:
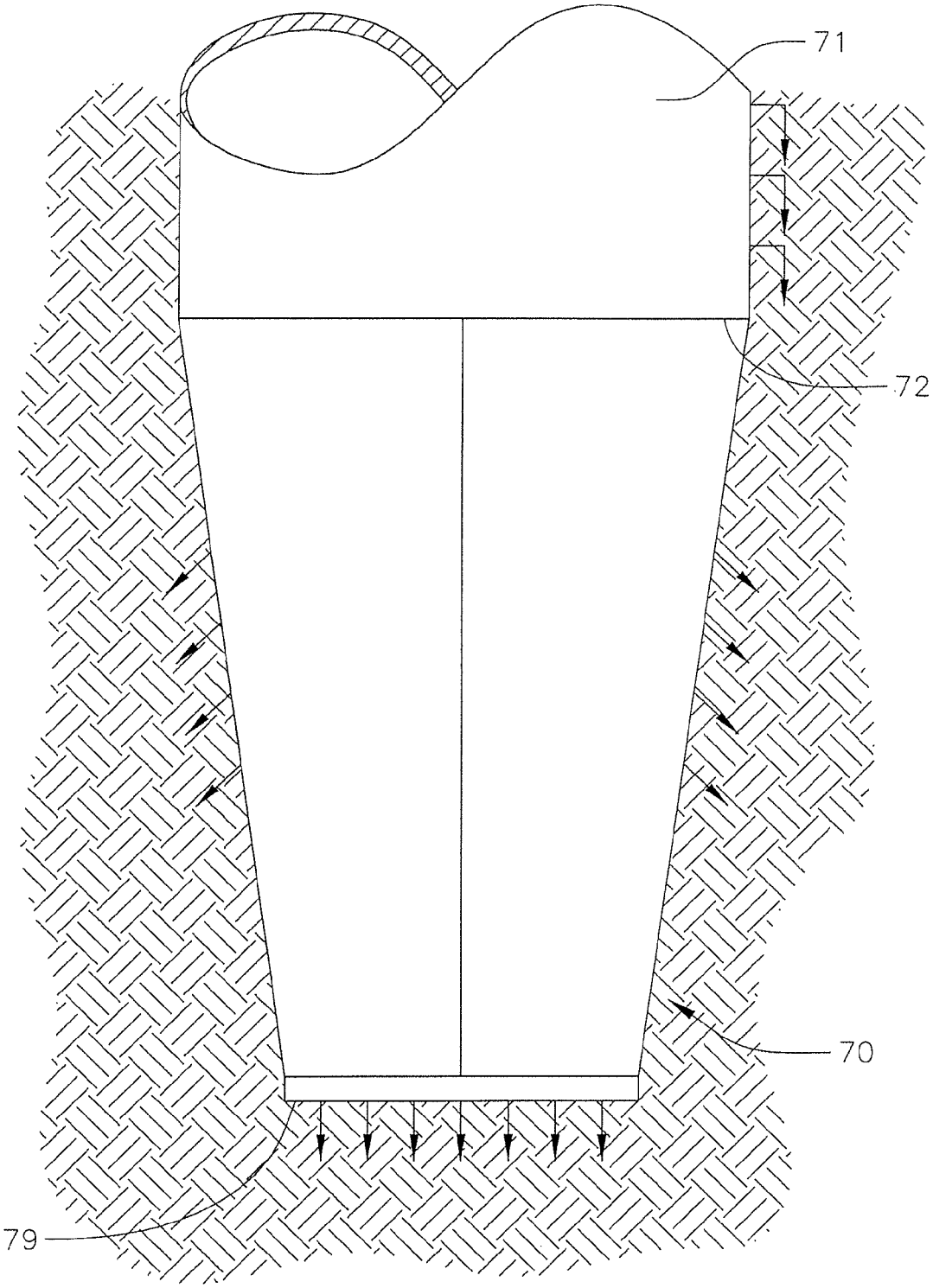
FIG. 7 shows an end bearing surface area detail of another embodiment of a pile tip.
Figure 8:
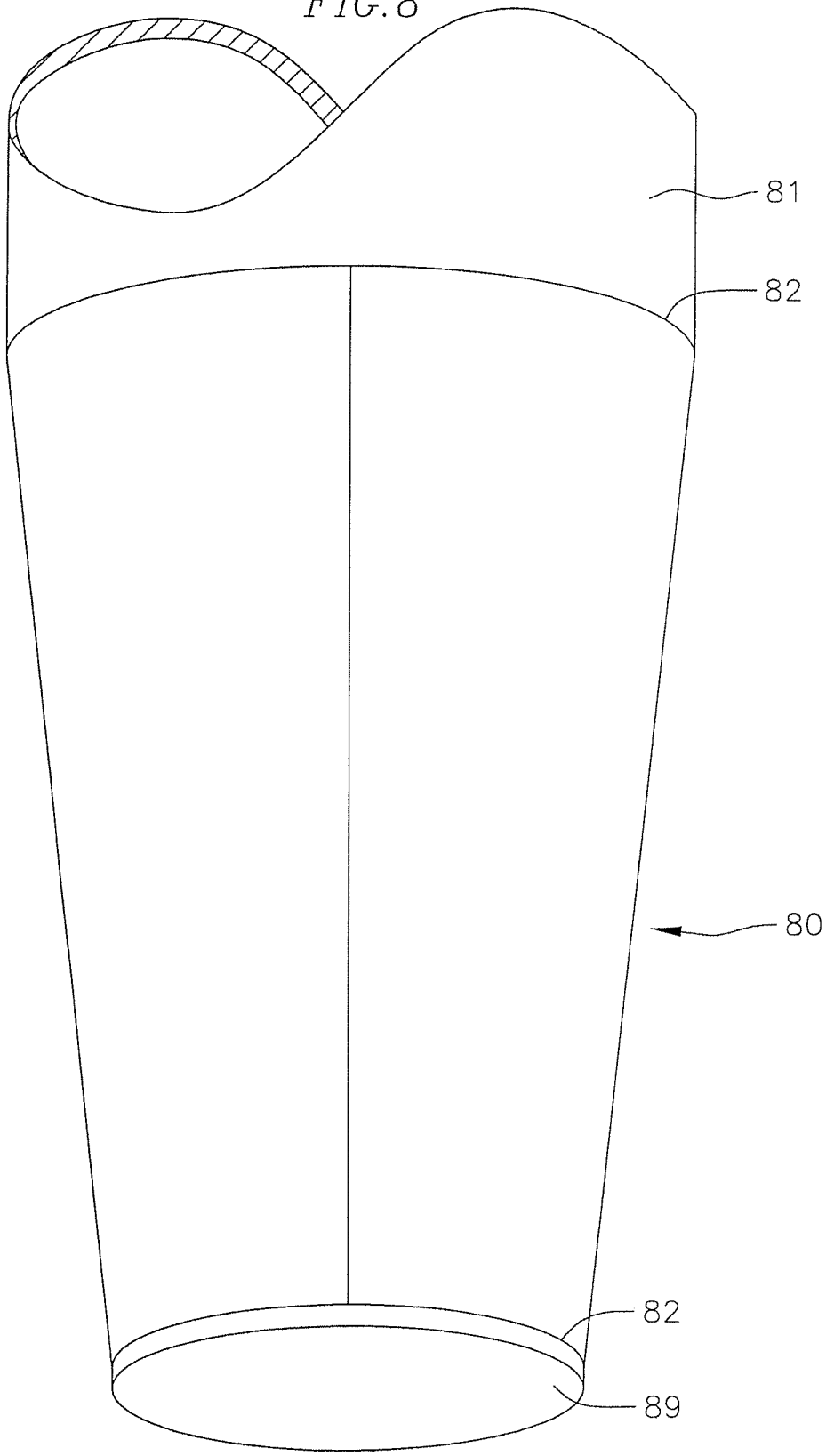
FIG. 8 shows another end bearing surface area detail of a further embodiment of a pile tip.

FIG. 7 shows an end bearing surface area detail of another embodiment of a simplified pile tip 70 assembled and attached to a pile 71 along welds 72. An end plate 79 is also provided attached to the remainder of the pile tip 70 using welds 72. The force vectors shown in FIG. 7 reflect the forces a pile tip 70 exerts on the surrounding soil bed as it is driven into the soil by the crowd pressure applied by a drilling rig connected to the distal end of the pile 71 (not shown). Likewise, the surrounding soil bed exerts reaction forces on the pile tip 70 in response to the force vectors shown. These forces, while significant, are not of as great a magnitude as those encountered when placing driven and drilled pile systems. As such, the disturbance to the soil surrounding the pile 71 is minimized as the pile 71 is sunk into the soil bed, which allows the surrounding soil to be packed tighter and therefore provide a more solid support for the pile 71, leading to greater ultimate load capacities. FIG. 8 shows another end bearing surface area detail of a further embodiment of a pile tip 80 assembled and attached to a pile 81 along welds 82. An end plate 89 is also provided attached to the remainder of the pile tip 80 using a welds 82.

Figure 9A:
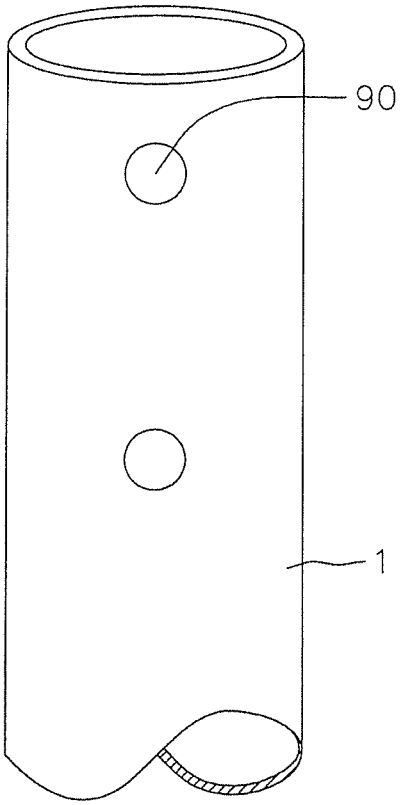
FIG. 9 shows an embodiment of a steel pipe pile provided with a series of driver pin holes 90.
Figure 9B:
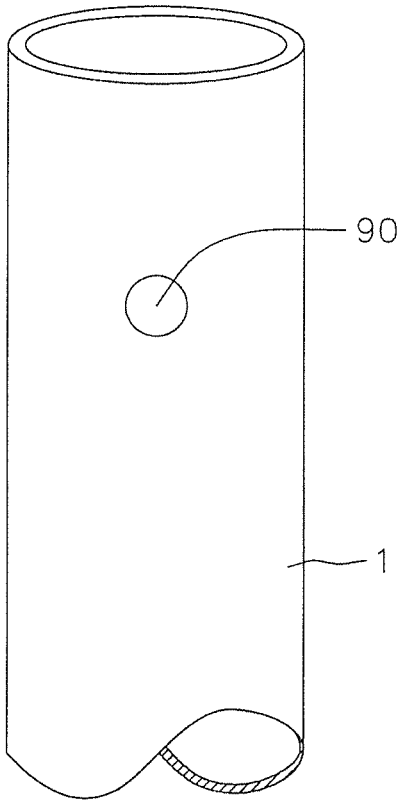

FIG. 9 shows an embodiment of the distal end of the pile 1 of FIG. 1, wherein the pile 1 is provided with a series of driver pin holes 90. These driver pin holes are provided so that the pile 1 may be secured to the reusable driver tool 100 shown in FIG. 10 which may be used to install a screw pile according to one embodiment of the present invention. The driver tool 100 may be secured to a standard drilling rig head 110 using an adaptor 119. The adaptor 119 consists of one or more adaptor brackets 120 provided with holes 121 which match corresponding holes on the driver tool 100 so that the adaptor brackets 120 may be attached thereto, an adaptor plate 130 which attaches to a standard drilling rig head 110, and an adaptor pivot 125 connecting the adaptor brackets 120 and the adaptor plate 130. With one end of the approximately tubular driver tool 100 connected to the adaptor 119 which allows the driver tool 100 to pivot with respect to the drilling rig head 110, the opposite end is provided with a series of holes 190. These holes 190 match the corresponding holes 90 in the pile 1 so that a pile 1 may be slid over the end of the driver tool 100 and held there with a series of pins passed through the holes 190 and their corresponding holes 90.

The driver tool 100 allows for a pile 1 to be quickly set up for use with a drilling rig head 110. A crew need only raise the driver tool 100 to a substantially horizontal position using a cable 102 connected to the attachment point 101 of the driver tool 100. The opposite end of the cable 102 may be secured at an overhead crane or winch for this purpose. Once the driver tool 100 is in a horizontal position, a pile 1 may be raised, and maneuvered over the end of the driver tool 100 before being secured there by the series of through-pins. A forklift or other piece of equipment may be used to raise the pile 1. In one embodiment, the pins passed through the holes 90 and 190 to secure the pile 1 to the driver tool 100 are themselves held in place in either by gravity or friction as the pile 1 is turned by the driver tool 100.

Figure 10:
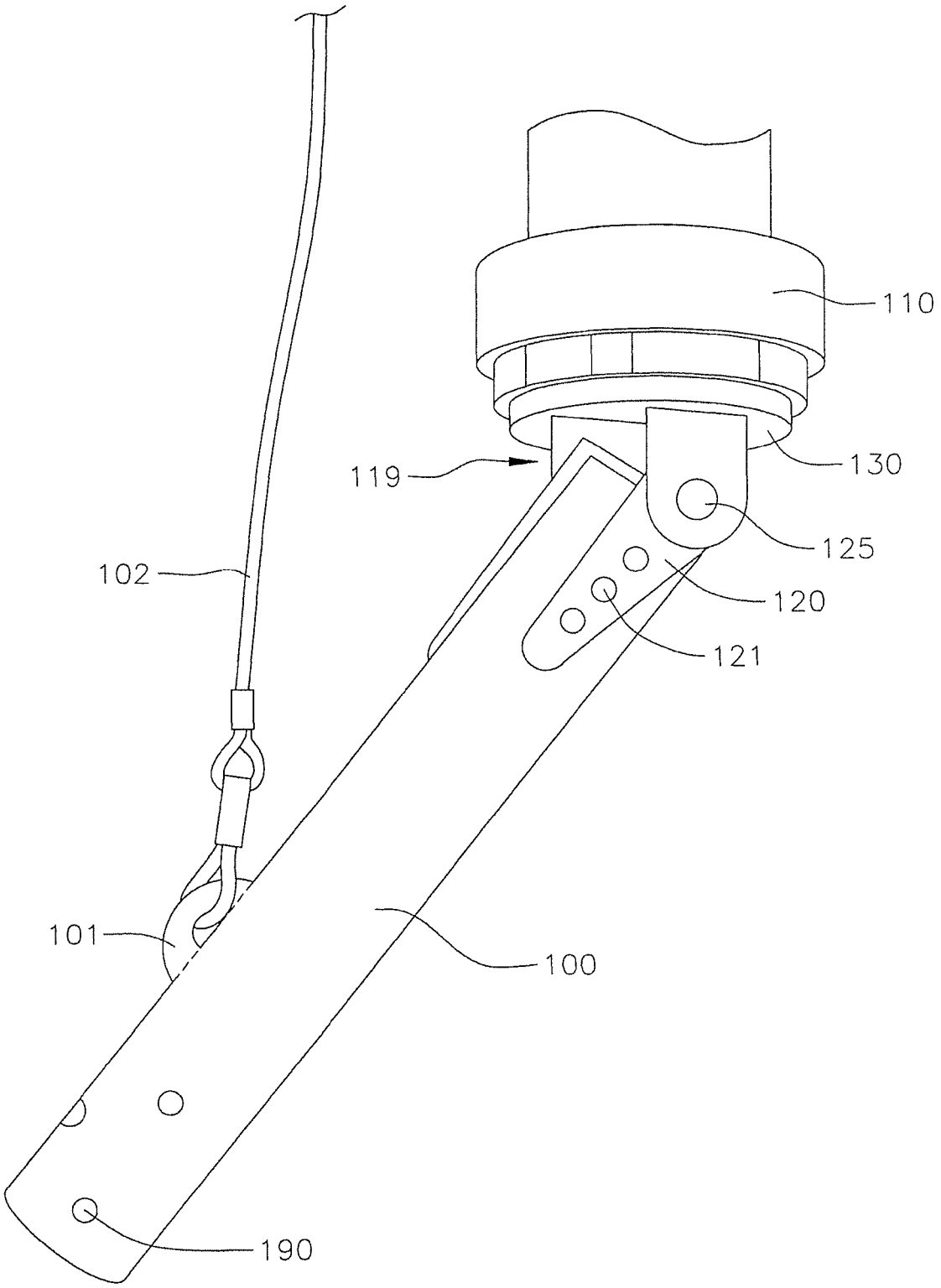
FIG. 10 shows an embodiment of a reusable driver tool for installing the screw pile of the present invention.

In an alternative embodiment, the rig head 110 shown in FIG. 10 may be replaced with a hydraulic chuck and the adaptor 119 may be dispensed with, so that the hydraulic chuck of the drill rig grasps the pile 1 directly, a portion of which pile passes upwards through an opening in the chuck as the pile is being turned into the soil bed. Although in this embodiment an operator would not be able to easily set up a pile in the horizontal position, allowing for excess lengths of pile to pass through the chuck permits much longer lengths of pile to be set up and installed. Some currently available drill rigs only allow the rig head a certain amount of vertical travel, so that it would be impractical to turn a single pile longer than approximately 65' into a soil by using the adaptor 119. With a hydraulic chuck allowing for an additional length of pile to pass upwards and through the rig head. Therefore with such a chuck installed, one could turn a certain length of the pile into the soil bed, loosen the chuck and run it back up the pile to repeat the operation as necessary until the oversized pile was completely turned into the soil.

In yet another alternative embodiment, a torque gauge can be applied to a pile during installation to determine the load rating of a particular pile in a manner roughly analogous to testing the depth of insertion of a driven pile for a specific force blow of the driver. The vertical travel of the pile is compared to the require torque for inducing the travel to estimate the solidity of the pile's engagement with the underlying soil bed and therefore its estimated load rating.

What is claimed is:

1. A screw pile substructure support system comprising:

a tubular pile having a centerline and a substantially constant diameter throughout a length of the tubular pile; and a pile tip comprising:

a tapered portion comprising a first end having a first diameter and a second end having a second diameter, wherein the first diameter is greater than the second diameter and about equal to the diameter of the tubular pile, and wherein the first end is attached to the tubular pile;

a first helical flight attached to and extending along an exterior surface of the tapered portion;

an end plate closing the second end of the tapered portion; and at least one protrusion extending outwardly from the end plate.

2. The screw pile substructure support system of claim 1, wherein the tubular pile is configured to be filled with concrete.

3. The screw pile substructure support system of claim 1, wherein the first helical flight has a pitch of about 1 inch to about 5 inches.

4. The screw pile substructure support system of claim 3, wherein the first helical flight has a pitch of about 3 inches.

5. The screw pile substructure support system of claim 1, wherein the tubular pile comprises standard milled steel and has a diameter of about 9 inches to about 15 inches and walls having a thickness of about ¼ inch to about ¾ inch.

6. The screw pile substructure support system of claim 1, wherein the tubular pile is filled with concrete and attached to a pile cap comprising concrete and reinforcing steel.

7. The screw pile substructure support system of claim 1, further comprising a plurality of cutter teeth disposed along the exterior surface of the tapered portion of the pile tip.

8. The screw pile substructure support system of claim 7, wherein the cutter teeth are disposed in a spiral pattern.

9. The screw pile substructure support system of claim 1, wherein the tubular pile includes a plurality of driver pin holes for securing the tubular pile to a reusable driver tool.

10. The screw pile substructure support system of claim 9, further comprising an adapter for securing the reusable driver tool to a drill rig head, wherein the adapter includes an adapter bracket coupleable to the driver tool, an adapter plate coupleable to the drill rig head, and an adapter pivot coupled to the adapter plate and the adapter bracket.

11. The screw pile substructure support system of claim 1, further comprising an adapter assembly comprising:

an adapter configured to be attached to a drill rig head of a drill rig, wherein the drill rig is configured to drive screw piles into the ground; and a driver tool comprising a cylindrical body having a first driver tool end coupled to the adapter and a second driver tool end opposite to the first driver tool end, wherein the driver tool is configured to pivot about a pivot axis at the first driver tool end, the pivot axis being perpendicular to a centerline of the drill rig head, wherein the second driver tool end is configured to be coupled with a section of the tubular pile.

12. The screw pile substructure support system of claim 11, wherein the second driver tool end is configured to fit within the section of the tubular pile.

13. The screw pile substructure support system of claim 12, further comprising a pin, wherein the second driver tool end comprises a plurality of holes configured to receive the pin, wherein the section of the tubular pile comprises a plurality of holes configured to receive the pin.

14. The screw pile substructure support system of claim 13, wherein the holes of the second driver tool end and the holes of the section of the tubular pile are configured to receive the pin when the holes of the second driver tool end and the holes of the section of the tubular pile are aligned.

15. The screw pile substructure support system of claim 11, further comprising a bracket attached to the first driver tool end.

16. The screw pile substructure support system of claim 15, wherein the bracket is configured to pivot about the pivot axis.

17. The screw pile substructure support system of claim 16, wherein the first driver tool end comprises a plurality of holes, and wherein the bracket comprises a plurality of holes.

18. The screw pile substructure support system of claim 17, wherein the plurality of holes of the first driver tool end and the plurality of holes of the bracket are configured to align to attach the bracket to the first driver tool end.

19. The screw pile substructure support system of claim 11, wherein the adapter comprises a circular end plate configured to be attached to the drill rig head.

20. The screw pile substructure support system of claim 19, wherein the adapter further comprises a pivot.

21. The screw pile substructure support system of claim 20, further comprising one or more brackets pivotably coupled to the circular end plate via the pivot.

22. The screw pile substructure support system of claim 21, wherein the one or more brackets are each attached to the first driver tool end.

23. The screw pile substructure support system of claim 22, wherein the first driver tool end comprises a plurality of holes, wherein the one or more brackets each comprise a plurality of holes, and wherein the plurality of holes of the first driver tool end and the plurality of holes of the one or more brackets are configured to align to attach the one or more brackets to the first driver tool end.

24. The screw pile substructure support system of claim 1, wherein the at least one protrusion comprises a cylindrical shaft extending axially outward from the end plate; and wherein the pile tip further comprises a second helical flight attached to and extending along an exterior surface of the cylindrical shaft.

25. The screw pile substructure support system of claim 1, wherein the first helical flight extends along the exterior surface for a distance of about one circumference of the tapered portion.

26. The screw pile substructure support system of claim 1, wherein the at least one protrusion comprises a point shaft extending axially outward from the end plate.

27. The screw pile substructure support system of claim 1, wherein the at least one protrusion comprises a bifurcated point shaft having two prongs and extending axially outward from the end plate.

28. The screw pile substructure support system of claim 27, wherein the two prongs are twisted in a helix.

29. A screw pile substructure support system comprising:

a tubular pile having a centerline and a substantially constant diameter throughout a length of the tubular pile; and a pile tip comprising:

a frustro-conical section comprising a first end having a first diameter and a second end having a second diameter, wherein the first diameter is greater than the second diameter and about equal to the diameter of the tubular pile, and wherein the first end is attached to the tubular pile;

a cylindrical section extending axially outward from the second end of the frustro-conical section;

at least one helical flight attached to and extending along an exterior surface of the frustro-conical section and an exterior surface of the cylindrical section, each of the at least one helical flight being spaced apart from an end of the pile tip that is opposite the tubular pile; and an end plate coupled to an end of the cylindrical section and having a substantially flat surface disposed perpendicular to the centerline of the tubular pile and having a diameter about equal to the second diameter.

30. The screw pile substructure support system of claim 29, wherein the at least one helical flight comprises a first helical flight attached to and extending along the exterior surface of the frustro-conical section, and a second helical flight attached to and extending along the exterior surface of the cylindrical section.

31. A method for installing a screw pile substructure support system comprising:

attaching a pile tip to a tubular pile having a substantially constant diameter throughout a length of the tubular pile to form a screw pile, wherein the pile tip comprises:

a tapered portion comprising a first end having a first diameter and a second end having a second diameter, wherein the first diameter is greater than the second diameter and about equal to the diameter of the tubular pile, and wherein the first end is attached to the tubular pile;

a helical flight attached to and extending along an exterior surface of the tapered portion;

an end plate closing the second end of the tapered portion; and at least one protrusion extending outwardly from the end plate;

positioning the screw pile above a preselected location of ground;

attaching a drill rig to the screw pile; and turning the screw pile to facilitate penetration of the ground.

32. The method of claim 31:

wherein the positioning the screw pile above the preselected location of ground comprises placing the screw pile in a substantially horizontal position; and wherein the attaching the drill rig to the screw pile comprises:

placing a driver tool of an adapter assembly in a substantially horizontal position, the adapter assembly comprising an adapter attached to a drill rig head of the drill rig, wherein the drill rig is configured to drive screw piles into the ground, wherein the driver tool comprises a cylindrical body having a first driver tool end coupled to the adapter and a second driver tool end opposite to the first driver tool end, wherein the driver tool is configured to pivot about a pivot axis at the first driver tool end, the pivot axis being perpendicular to a centerline of the drill rig head; and attaching the second driver tool end to an end of the screw pile.

33. The method of claim 32, wherein the placing the driver tool in the substantially horizontal position comprises positioning the driver tool on the ground.

34. The method of claim 32, wherein the placing the driver tool in a substantially horizontal position comprises lifting a cable attached along the cylindrical body of the driver tool.

35. The method of claim 32, where the attaching the second driver tool end to the end of the screw pile comprises inserting the second driver tool end within the end of the screw pile.

36. The method of claim 32, further comprising:

attaching a plurality of sections of the tubular pile to form the tubular pile.

37. The method of claim 32:

wherein the second driver tool end and the screw pile each comprise a plurality of holes, wherein the attaching the second driver tool end to the end of the screw pile comprises:

aligning the plurality of holes of the screw pile and the plurality of holes of the second driver tool end; and inserting a pin into the plurality of holes of the screw pile and the plurality of holes of the second driver tool end.

38. The method of claim 32, wherein the placing the screw pile in the substantially horizontal position comprises placing the screw pile in the substantially horizontal position on the ground.

39. A screw pile substructure support system comprising:

a tubular pile having a centerline and a substantially constant diameter throughout a length of the tubular pile; and a pile tip comprising:

a first portion comprising a first end having a first diameter and a second end having a second diameter, wherein the first diameter is greater than the second diameter and about equal to the diameter of the tubular pile, and wherein the first end is attached to the tubular pile;

a first helical flight attached to and extending along an exterior surface of the first portion;

an end plate closing the second end of the first portion; and at least one protrusion extending outwardly from the end plate.

* * * * *